US010299656B2

(12) United States Patent
Parmeggiani

(10) Patent No.: US 10,299,656 B2
(45) Date of Patent: May 28, 2019

(54) VENT OUTLET FOR APPLIANCE HAVING ADJUSTABLE KICKPLATE

(71) Applicant: ELECTROLUX HOME PRODUCTS, INC., Charlotte, NC (US)

(72) Inventor: Alessandro Parmeggiani, Solaro (IT)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 345 days.

(21) Appl. No.: 15/347,014

(22) Filed: Nov. 9, 2016

(65) Prior Publication Data

US 2018/0125329 A1 May 10, 2018

(51) Int. Cl.
*A47L 15/48* (2006.01)

(52) U.S. Cl.
CPC ..... *A47L 15/488* (2013.01)

(58) Field of Classification Search
CPC ..... A47L 15/488
USPC ..... 134/56 D
See application file for complete search history.

(56) References Cited

U.S. PATENT DOCUMENTS

| | | | |
|---|---|---|---|
| 2,534,690 | A | 12/1950 | Young, Jr. et al. |
| 4,290,660 | A | 9/1981 | Brezosky |
| 4,932,224 | A | 6/1990 | Katterhenry et al. |
| 5,524,358 | A | 6/1996 | Matz |
| 5,582,199 | A | 12/1996 | Schmidt et al. |
| 5,613,747 | A | 3/1997 | Becker et al. |
| 5,820,168 | A | 10/1998 | De Giacomoni |
| 6,666,531 | B2 | 12/2003 | Flowers |
| 6,764,147 | B2 | 7/2004 | Flowers |
| 7,867,340 | B2 | 1/2011 | Pyo et al. |
| 8,371,665 | B2 | 2/2013 | Herrera et al. |
| 8,696,824 | B2 | 4/2014 | Jadhav et al. |
| 2004/0011390 | A1 | 1/2004 | Flowers |
| 2008/0238274 | A1 | 10/2008 | Seo et al. |
| 2009/0286464 | A1 | 11/2009 | Sanchez |
| 2011/0101836 | A1 | 5/2011 | Gamble et al. |
| 2012/0280607 | A1 | 11/2012 | Doberstein et al. |
| 2014/0150286 | A1 | 6/2014 | Jadhav et al. |
| 2015/0113825 | A1* | 4/2015 | Goulet ..... D06F 58/10 34/443 |
| 2017/0258291 | A1 | 9/2017 | Dirisala et al. |

(Continued)

FOREIGN PATENT DOCUMENTS

| | | | |
|---|---|---|---|
| DE | 10064119 | A1 | 6/2002 |
| DE | 102004058196 | A1 | 6/2006 |
| DE | 202012100405 | U1 | 7/2013 |

(Continued)

*Primary Examiner* — David J Laux
(74) *Attorney, Agent, or Firm* — Alston & Bird LLP

(57) ABSTRACT

A vent outlet for an appliance having an adjustable kick plate configured to enclose a base portion of the appliance is provided. In an example embodiment, the vent outlet comprises a top portion, a vent cover, a bottom portion, and a conduit portion. The top portion comprises a planar portion and an angled portion. The front surface of the vent cover is coplanar with the front surface of the planar portion. The bottom portion that is recessed with respect to the front surface of vent cover. The planar portion, the vent cover, and the bottom portion are generally aligned along a first axis. The conduit portion extends backward from a plane defined by the vent cover and is configured to secure the vent outlet to a vent conduit of the appliance.

20 Claims, 13 Drawing Sheets

(56) References Cited

U.S. PATENT DOCUMENTS

| | | | | |
|---|---|---|---|---|
| 2017/0258292 | A1 | 9/2017 | Dirisala et al. | |
| 2018/0149405 | A1* | 5/2018 | Kilinc | F25B 13/00 |

FOREIGN PATENT DOCUMENTS

| | | | |
|---|---|---|---|
| EP | 1583456 | B1 | 4/2009 |
| EP | 2425747 | B1 | 5/2013 |
| EP | 2628433 | A1 | 8/2013 |
| EP | 2786692 | A1 | 10/2014 |
| EP | 2610394 | B1 | 4/2015 |
| JP | 2003-111713 | A | 4/2003 |
| WO | WO 2004/058037 | A1 | 7/2004 |

* cited by examiner

VENT OUTLET FOR APPLIANCE HAVING ADJUSTABLE KICKPLATE

BACKGROUND

Field of the Invention

The present invention generally relates to appliances, such as dishwashers, that have adjustable kick plates. In particular, the present invention relates to appliances, such as dishwashers, that have adjustable kick plates and a vent opening disposed underneath the dishwasher.

Description of Related Art

An appliance may comprise a vent that is configured to allow air, gas, or other fluids to pass between an interior chamber of the appliance and an area external to the appliance. For example, a dishwasher may comprise a vent configured to allow warm, moist air to leave the tub of the dishwasher. The vent may exit from the top of the tub and extend toward the bottom of the dishwasher to allow moisture in the warm air to condense before the warm air leaves the vent and enters the area external to the dishwasher.

An appliance may further comprise an adjustable kick plate. For example, the kick plate may be adjustable such that a bottom edge of the kick plate is flush with the floor. Such adjustment of the kick plate may prevent user interaction with appliance components located underneath the appliance and may dampen noise emitted from underneath the appliance. However, if the vent outlet is located below the dishwasher, the adjustability of the kick plate may be hampered.

Accordingly, there is a need in the art for an improved vent outlet and/or kick plate for an appliance having an adjustable kick plate.

BRIEF SUMMARY

Embodiments of the present invention address the above by providing a vent outlet and adjustable kick plate and an appliance comprising the vent outlet and adjustable kick plate. The vent outlet and adjustable kick plate are configured to dampen noise that may be emitted by from below the appliance while allowing the kick plate to be adjusted about the vent outlet. The vent outlet and adjustable kick plate are further configured to prevent user access to the area underneath the appliance. In example embodiments, the kick plate is selectively detachable from the appliance such that connection and installation of the appliance can be completed without moving or affecting the vent conduit and/or the vent outlet. For example, the kick plate may be selectively detachable by pulling the kick plate frontward.

According to a first aspect of the present invention, a vent outlet for an appliance having an adjustable kick plate configured to enclose a base portion of the appliance is provided. In an example embodiments, the vent outlet comprises a top portion, a vent cover, a bottom portion, and a conduit portion. The top portion comprises a planar portion. The front surface of the bottom portion is recessed with respect to the front surface of the vent cover. The planar portion, the vent cover, and the bottom portion are generally positioned along a first axis such that the planar portion is disposed on a first side of the vent cover and the bottom portion is disposed on a second side of the vent cover. The second side is the opposite of the first side and is along the first axis. The conduit portion extends backward from a plane defined by the front surfaces of the vent cover and the planar portion. The conduit portion is configured to secure the vent outlet to a vent conduit of the appliance.

In example embodiments, the top portion further comprises an angled portion and a support vein matrix that partially fills the space between the angled portion and the conduit portion. In example embodiments, a top edge of the angled portion is curved. In example embodiments, the front surface of the vent cover comprises a matrix surface comprising a plurality of openings sized to prevent intrusion of digits while allowing fluid to pass through the front surface of the vent cover. In example embodiments, each of the plurality of openings is approximately 3-6 mm in size. In example embodiments, a lower support vein extends between the bottom portion and the conduit portion. The lower support vein is configured to prevent bending or twisting of the bottom portion. In example embodiments, a front surface of the bottom portion is recessed by approximately 0.5-3 mm with respect to the front surface of the vent cover. In example embodiments, the conduit portion comprises at least one attachment mechanism mate on an end thereof opposite the vent cover and configured to secure the vent outlet to a vent conduit of the appliance. In an example embodiments, the conduit portion defines a second axis that is normal and/or perpendicular to the first axis.

According to another aspect of the present invention, an appliance is provided. In example embodiments, the appliance comprises an adjustable kick plate comprises a vent opening, a vent conduit that is disposed behind the kick plate, and a vent outlet. The vent outlet is secured to the vent conduit and configured to prevent access to a base portion of the appliance through the vent opening. The vent outlet comprises a top portion, a vent cover, and a bottom portion. The top portion configured to prevent access to the base portion of the appliance through a portion of the vent opening located above the vent cover when the kick plate is in a position other than a second position. The vent cover is configured to prevent intrusion of digits into a flow path defined by the vent outlet and allow fluid to pass through the vent cover. The bottom portion is positioned behind the kick plate and configured to prevent access to the base portion of the appliance through a portion of the vent opening located below the vent cover when the kick plate is in a position other than a first position.

In example embodiments, a front surface of the top portion and a front surface of the vent cover are generally coplanar and flush with a front surface of the kick plate. In some example embodiments, the top portion is positioned behind the kick plate and a front surface of the vent cover is generally coplanar and flush with a front surface of the kick plate. In some example embodiments, the top portion comprises a top edge that is configured to align with the top edge of the vent opening when the kick plate is in the first position. In example embodiments, the first position is located at one end of an adjustment range of the adjustable kick plate and the second position is located at an opposite end of the adjustment range of the adjustable kick plate. In example embodiments, the bottom portion is recessed with respect to the vent cover by approximately a thickness of the kick plate. In example embodiments, the top portion of the vent outlet comprises a support vein matrix disposed behind the front surface of the top portion and configured to (a) prevent intrusion of digits into the base portion of the appliance through a portion of the vent opening located above the vent cover when the kick plate is in a position other than the first position and also (b) providing driving ribs for the adjustment of the kick plate (with respect the vent cover). In an example embodiment, the kick plate comprises a planar section and an angled section, the angled section angles back toward the base portion of the appliance. In example embodiments, the vent outlet further comprises a conduit portion configured to provide a flow path for fluids between the vent conduit and the vent cover. In example embodiments, the vent conduit comprises one or more attachment mechanisms and the conduit portion comprises one or more corresponding attachment mechanism mates, at least one of the one or more attachment mechanisms is mated to a corresponding one of the one or more attachment mechanism mates to secure the vent outlet to the vent conduit. In example embodiments, a front surface of the vent cover comprises a matrix surface comprising a plurality of openings. The openings are configured to (a) prevent intrusion of digits into the flow path and (b) allow fluid to pass through the front surface of the vent cover.

BRIEF DESCRIPTION OF THE SEVERAL VIEWS OF THE DRAWING(S)

Having thus described embodiments of invention in general terms, reference will now be made to the accompanying drawings, which are not necessarily drawn to scale, and wherein:

DETAILED DESCRIPTION OF PREFERRED EMBODIMENTS OF THE PRESENT INVENTION

The present invention now will be described more fully hereinafter with reference to the accompanying drawings, in which some, but not all embodiments of the invention or inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. While embodiments of the present invention may relate to various types of appliances, the illustrative example of a dishwasher with an adjustable kick plate will be described in detail below.

Overview of an Example Dishwasher

Figure 1:
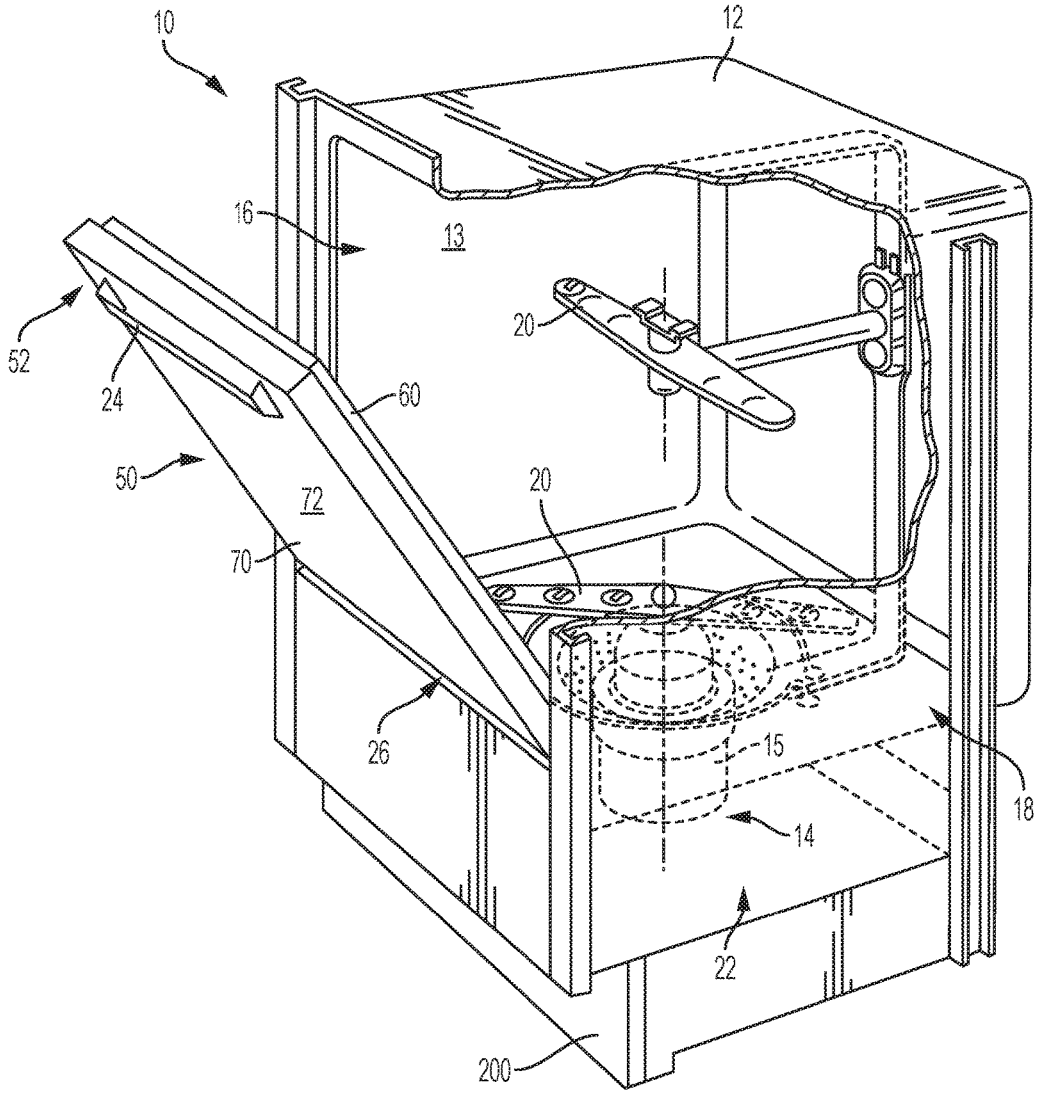
FIG. 1 is a perspective view of a dishwasher of a type suitable for use with various embodiments of the present invention.
Figure 2:
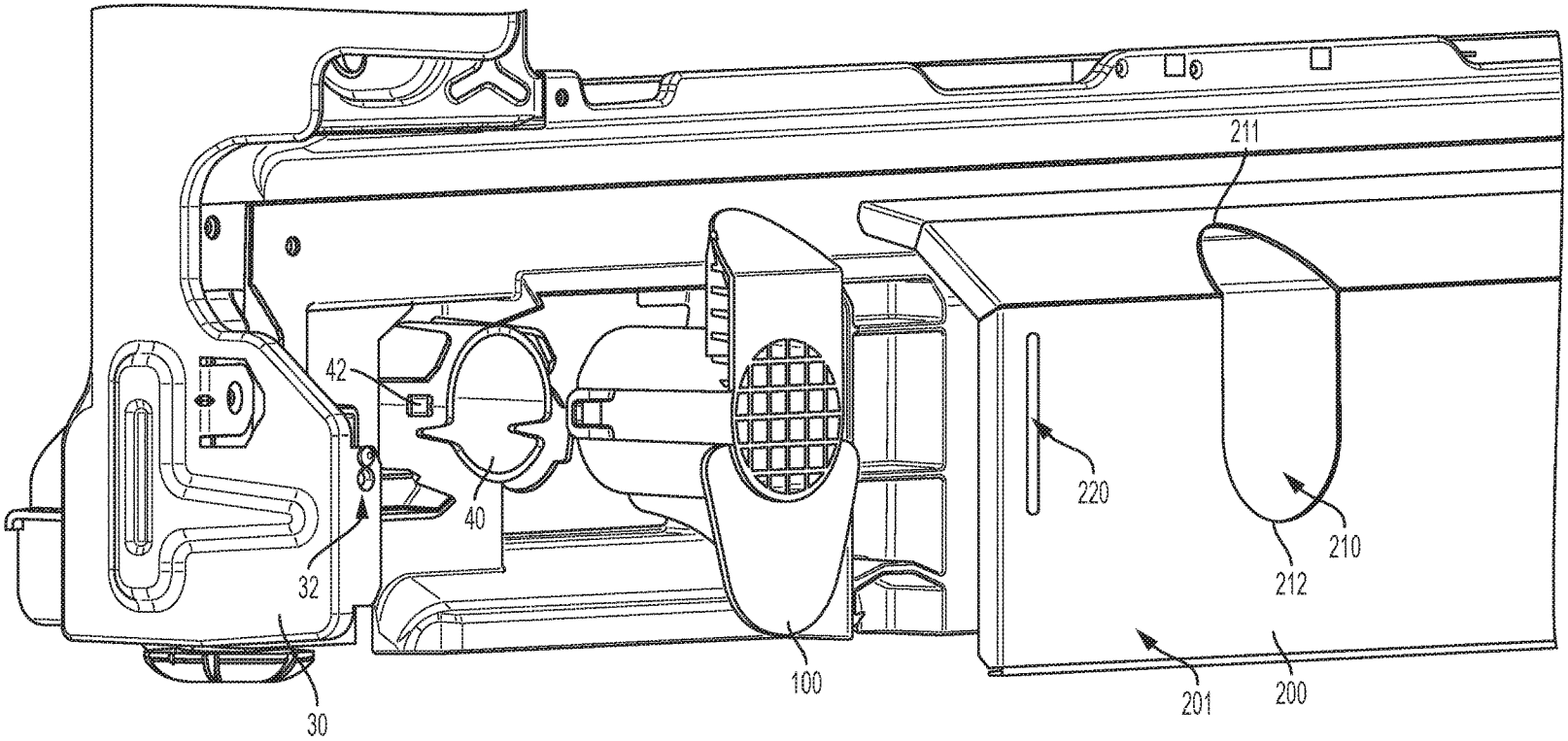
FIG. 2 is a view of an exploded perspective view of the bottom of a dishwasher, vent outlet, and kick plate consistent with an exemplary embodiment of the present invention.

FIG. 1 illustrates an example of a dishwasher 10 that may benefit from various embodiments of the present invention. The dishwasher 10 may include a tub portion 12 (partly broken away in FIG. 1 to show internal details) having a door assembly 50 and a plurality of walls 13 that together form an enclosure in which dishes, utensils, and other dishware may be placed for washing. The tub portion 12 may also define a forward access opening, generally designated as 16. As known in the art, the dishwasher 10 may also include slidable lower and upper racks (not shown) for holding the dishes, utensils, and other dishware to be washed.

The tub portion 12 may define a sump, generally designated as 14, in which wash water or rinse water is collected, typically under the influence of gravity. The wash/rinse water may be pumped by a pump 15 out of the sump 14 to various spray arms 20 mounted in the interior of the tub portion 12 for spraying the wash/rinse water, under pressure, onto the dishes, utensils, and other dishware contained therein. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports a lower end, generally designated as 18 of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

The door assembly 50 may be pivotably engaged with the tub portion 12 about the lower end 18 thereof so as to selectively permit access to the interior of the tub portion 12. That is, a lower edge 26 of the door assembly 50 may be pivotably engaged (e.g., hinged) with the lower end 18 of the tub portion 12 such that the door assembly 50 is pivotable about the lower edge 26 thereof to cover and seal the forward access opening 16 in a closed position when the dishwasher 10 is in operation, and to provide access to the interior of the tub portion 12 through the forward access opening 16 when the door assembly 50 is pivoted from the closed position to an opened position. In some instances, the door assembly 50 may comprise an inner wall 60 and an outer wall 70. The door assembly 50 may include a handle member 24 disposed on an outer surface 72 of the outer wall 70, to provide the user with a grasping portion.

Embodiments of the present invention generally relate to a kick plate 200 located generally below the door assembly 50 and configured to prevent access to the base portion 22 of the dishwasher 10. Example embodiments of the present invention further generally relate to a vent outlet 100 (see FIGS. 2-11) configured to allow a vent to exit from the base portion 22 of the dishwasher 10 without preventing the kick plate from enclosing the base portion 22 of the dishwasher. Moreover, the vent outlet 100 is configured to allow the kick plate to be adjusted without gaps being formed about the vent outlet 100 that provide access to the base portion 22. The kick plate 200 is also selectively detachable from dishwasher for allowing installation of the dishwasher (e.g., water and energy supply connections), without affecting the vent conduit 40 and/or vent outlet 100.

Exemplary Vent Outlet

For example, a vent inlet may be positioned proximate the top of the door assembly 50 such that the inlet is disposed on an interior wall or other interior portion of the door assembly 50. In another example, a vent inlet may be positioned proximate the top of a sidewall 13 the tub 12. In such a position, warm moist air may enter the vent inlet from a top portion of the tub 12. A vent may extend from an inlet end located at the vent inlet to an outlet end located at the vent outlet. The warm moist air may travel through the vent toward the outlet end of the vent located in the base portion 22 of the dishwasher. As the warm moist air travels through the vent, moisture may condense out of the warm air. The warm air may then exit the vent through the vent outlet 100. Examples of such vents may be found in U.S. Pat. No. 8,696,824 and U.S. Publ. No. 2014/0150286 which are hereby incorporated herein in their entireties.

As noted above, the kick plate 200 may be disposed such that the kick plate 200 prevents access to the base portion 22 of the dishwasher 10 from the front of the dishwasher. In example embodiments, the outlet end of the vent may be generally co-positioned with at least a portion of the kick plate 200. FIGS. 2-6 illustrate example embodiments of a vent outlet 100 secured to a dishwasher 10 such that the outlet end of the vent is generally flush with a front surface of the kick plate 200. For example, the kick plate 200 may comprise a vent opening 210 configured to allow a portion of the vent outlet 100 to pass there-through such that the front surface of the vent cover 110 is generally flush with the front surface of the kick plate 200. The vent outlet may comprise sealing surfaces (e.g., front surface 121 of the top portion 120, front surface 131 of the bottom portion 130, matrix surface 114) for sealing the vent opening 210 against intrusion of digits therethrough. Example embodiments of a vent outlet 100 will now be described in more detail.

FIGS. 7-11 show various views of an example vent outlet 100. In example embodiments, the vent outlet 100 may be made by molding, extruding, sculpting, etching, or printing plastic or other polymer material or other appropriate material. In example embodiments, a vent outlet 100 comprises a top portion 120, a vent cover 110, and a bottom portion 130. In example embodiments, the vent outlet 100 may further comprise a conduit portion 140 configured to secure the vent outlet 100 to a vent conduit 40 disposed in the base portion 22 of the dishwasher 10. The conduit portion 140 may provide a flow path 145 for fluids (e.g., air) between the vent conduit 40 and the vent cover 110. For example, the conduit portion 140 may be configured to extend the outlet end of the vent from the vent conduit 40 to the vent cover 110.

In example embodiments, the top portion 120, vent cover 110, and bottom portion 130 may define a first axis 150. In particular, the top portion 120 may be located on a first side of the vent cover 110 and the bottom portion 130 may be located on a second side of the vent cover 110. The second side of the vent cover 110 may be opposite the first side of the vent cover 110 such that the top portion 120, vent cover 110, and bottom portion 130 extend along a portion of the first axis 150. The vent conduit 140 may extend away from an interior side of the vent cover 110, such that the vent conduit 140 defines a second axis 155. The second axis 155 is askew with respect to the first axis 150. In particular, in some embodiments, the second axis 155 may be normal or perpendicular to the first axis 150.

In example embodiments, a front surface 121 of the top portion 120 may comprise a planar component 122 and an angled component 123. In example embodiments, the planar component 122 may define a plane wherein the first axis 150 lies in the plane. The surface of planar component 122 may be smooth or textured, as appropriate for the application. The angled component 123 may generally extend along the first axis 150 and out from the plane defined by the planar component 122. In example embodiments, the angled portion 123 may generally extend along the first axis 150 and angle toward the second axis 155. For example, the angled portion 123 may angle back along a portion of the conduit portion 140. The front surface of the angled portion 123 may be smooth or textured as appropriate for the application. In general, the front surface of the angled component 123 may have the same surface characteristics (e.g., same texture) as the planar portion 122 to provide a cohesive aesthetic appearance. In example embodiments, a top edge 124 of the angled portion 123 is curved.

In example embodiments, the top portion 120 further comprises a support vein matrix 125. For example, the support vein matrix 125 may comprise one or more first support veins 126 and one or more second support veins 127. The first and second support veins extend outward from the back surface 128 of the top portion 120. The first support veins 126 extend between the angled component 123 and the conduit portion 140. For example, the first support veins 126 may extend in the direction of the first axis 150. For example, the first support veins 126 may extend between the angled component 123 and the conduit portion 140 such that the length of each of the first support veins 126 is parallel to the first axis. The second support veins 127 may extend outward from the back surface 128 of the top portion 120 such that each second support vein 127 intersects one or more of the first support veins 126. For example, the second support veins 127 may be generally perpendicular to the one or more first support veins 126. In an example embodiment, the second support veins are perpendicular to both the first axis 150 and the second axis 155. The one or more second support veins 127 may be spaced along the length of the first support veins 126. In example embodiments, a depth of the first and second support veins 126, 127 extends away from the back surface 128 of the planar component 122. For example, the depth of the first and second support veins 126, 127 may extend outward from the back surface of the planar component 122 in a direction that is generally parallel with the second axis 155. In an example embodiment, the first and second support veins 126, 127 may extend outward from the back surface 128 of the planar component 122 to a distance defined by the angled component 123. For example, the depth of the first and second support veins 126, 127 may be approximately the same as the distance defined by the projection of the angled component 123 onto the second axis 155. In example embodiments, the support vein matrix 125 may be configured to structurally support the top portion 120 and/or to assist the vent outlet 100 in preventing access to the base portion 22 of the dishwasher through the vent opening 210 in the kick plate 200, as will be discussed in more detail elsewhere herein. In example embodiments, the support vein matrix may provide driving ribs for the adjustment of the kick plate 200 with respect to the vent outlet 100.

In example embodiments, the vent outlet 100 further comprises the vent cover 110. The vent cover may be configured to allow fluid (e.g., air) to enter or exit the flow path 145 through the front surface of the vent outlet 100. For example, the front surface of the vent cover 110 may comprise a matrix surface 114 comprising a plurality of openings 112. For example, the matrix surface 114 may comprise a plurality of square, rectangular, round, elliptical, or other openings 112 configured to allow fluid to enter or exit the flow path 145 through the front surface of the vent outlet 100. In example embodiments, the openings 112 may be sized to prevent intrusion of digits into the flow path 145 through the front surface of the vent outlet 100. For example, in example embodiments, the openings 112 are square openings having a side length of 3-6 mm. For example, in one embodiment, the openings 112 are square openings having a side length of 5.5 mm. In example embodiments, the matrix surface 114 defines a plane that is parallel to the plane defined by the planar portion 122. In an example embodiment, the matrix surface 114 and the planar portion 122 together define a front outlet plane. For example, the front surface 121 of the planar portion 122 may be coplanar with the front surface of the matrix surface 114.

In example embodiments, the vent outlet 100 further comprises a bottom portion 130. The bottom portion extends from the vent cover 110 downward along the first axis 150. In particular, the bottom portions extends from the vent cover 110 in a direction along the first axis 150 that is opposite of the direction along the first axis that the top portion 120 extends outward from the vent cover 110 such that the top portion 120 extends out from the vent cover 110 in a first direction and the bottom portion 130 extends out from the vent cover 110 in a second direction that is opposite the first direction.

In example embodiments, a flange 132 is disposed between the vent cover 110 and the bottom portion 130. For example, the bottom portion 130 may be recessed with respect to the vent cover 110. For example, the front surface of the vent cover 110 may be configured to be flush with a front surface of a kick plate 200. The bottom portion 130, however, may be configured to be disposed behind the kick plate 200. For example, the bottom portion 130 may be configured such that the front surface of the bottom portion 130 abuts and/or is adjacent to the back surface of the kick plate 200. For example, the flange 132 may recess the front surface 131 of the bottom portion approximately 0.5-3 mm with respect to the front surface of the vent cover 110. In example embodiments, the front surface 131 of the bottom portion 130 may be textured similarly to the front surface 121 to provide a cohesive aesthetic appearance.

The bottom portion may further comprise a lower support vein 134, in example embodiments. The lower support vein 134 extends from a back surface 133 of the bottom portion 130 to the conduit portion 140. In example embodiments, the lower support vein 134 is configured to provide structural support to the bottom portion 130 such that the bottom portion 130 may not be easily bent or twisted. For example, a user may not bend or twist the bottom portion 130 by pressing upon the front surface 131 of the bottom portion 130 with their fingertips. In example embodiments, the lower support vein 134 extends approximately 80-100% along the length of the bottom portion 130 and extends generally 80-100% along the length of the conduit portion 140. The lower support vein 134 may taper up toward the conduit portion 140 as it extends away from the back surface 131 of the bottom portion 130.

In example embodiments, the vent outlet 100 further comprises a conduit portion 140. The conduit portion extends outward from the back surface of the vent cover 110 along the second axis 155. In example embodiments, the conduit portion 140 is generally shaped as a hollow tube and comprises mechanisms for securing the vent outlet 100 to the dishwasher 10. For example, the conduit portion 140 is configured to be secured to a vent conduit 40 of the dishwasher 10. For example, the conduit portion 140 may comprise one or more attachment mechanism mates 142 configured to mate with corresponding attachment mechanisms 42 of the vent conduit 40 to secure the conduit portion 140 to the vent conduit 40. For example, an attachment mechanism mate 142 may be configured to slide, snap, click, rotate, and/or lock onto and/or into a corresponding attachment mechanism 42 to secure the vent outlet 100 to the vent conduit 40.

In example embodiments, the vent conduit 40 may be the outlet of a vent of the dishwasher 10 and the vent outlet 100 may be secured, attached, mounted, affixed, and/or the like onto the vent conduit 40 to extend the vent. In example embodiments, the conduit portion 140 is generally hollow such that the interior of the conduit portion 140 defines a flow path 145. For example, the conduit portion 140 may extend the vent through flow path 145 such that the outlet end of the vent is located at the vent cover 110. For example, the conduit portion 140 may be configured to define a flow path 145 for providing a fluid flow path from the vent conduit 40 to the vent cover 110. In example embodiments, the conduit portion 140 may extend approximately 30-60 mm along the second axis 155. For example, the conduit portion 140 may be approximately 30-60 mm in length. In one example embodiment, the vent outlet 100 extends the vent approximately 45 mm by providing the flow path 145 from the vent conduit 40 to the vent cover 110.

Exemplary Kick Plate

FIGS. 2-6 provide various view of portions of a dishwasher 10 comprising a vent outlet 100. As described above, a dishwasher 10 may comprise a tub 12 that is enclosed by a door 50 such that dishware may be enclosed into the tub 12 for washing, rinsing, cleaning, and/or the like. The dishwasher 10 may further comprise a chassis 30 providing the structural frame of the dishwasher. The base portion 22 of the dishwasher 10 may be generally accessible from the front of the dishwasher such that access may be permitted to the base portion 22 of the dishwasher 10 for maintenance or repairs. However, to prevent intrusion of digits or other objects and to reduce noise emitted during operating of the dishwasher, the base portion 22 is generally enclosed by kick plate 200.

Figure 12:
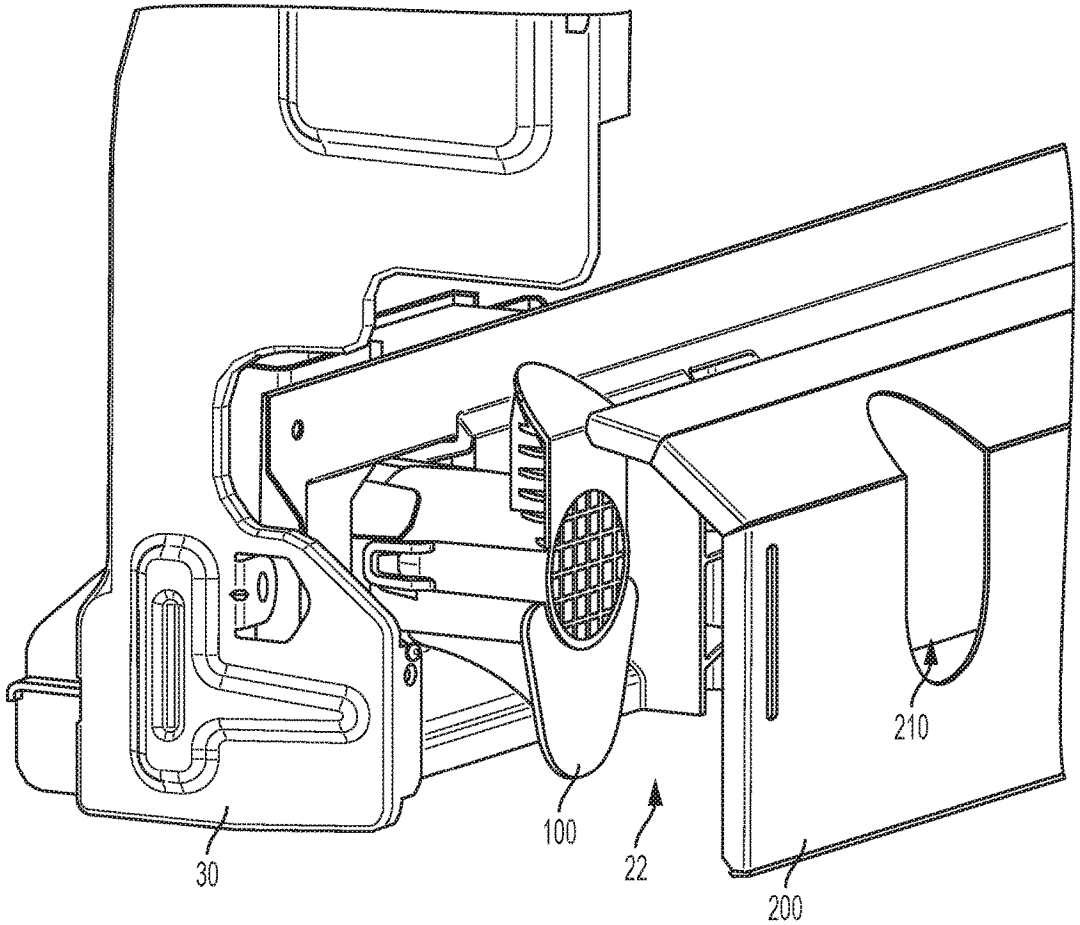
FIG. 12 shows a view of the kick plate being removed from the dishwasher without affecting the vent outlet secured to the vent conduit.

As shown in FIG. 12, in example embodiments, the kick plate is selectively detachable from the appliance to allow access to the base portion 22 of the dishwasher for installation of the dishwasher, connection of water and/or electricity supply, connection of drainage, maintenance, repairs, and/or the like. In example embodiments, the connection and installation of the dishwasher can be completed without moving or affecting the vent conduit and/or the vent outlet. For example, the kick plate may be selectively detachable by pulling the kick plate frontward. In example embodiments, the kick plate 200 may be configured to be secured to the chassis 30 by one or more fasteners 34 that engage the kick plate 200 through the adjustment slots 220. For example, a fastener 34 may be disposed through an adjustment slot 220 and secured into the chassis 30 through the kick plate fastener holes 32. The adjustment slots 220 may be configured to allow for adjustment of the kick plate 200 in a direction that is generally parallel to the first axis 150. In an example embodiment, the adjustment slots 220 allow the kick plate 200 to be adjusted by approximately 30 mm in a direction that is parallel to the first axis 150. Generally a kick plate 200 is adjustable such that the lower edge of the kick plate 200 may be adjusted to be approximately flush with a surface upon which the dishwasher 10 is positioned. For example, in some embodiments, the kick plate 200 may be vertically adjusted such that the lower edge of the kick plate 200 is flush or adjacent to and/or abuts the floor on which with dishwasher 10 is positioned.

As illustrated in FIGS. 2-6 and 12, in example embodiments, the kick plate 200 may comprise a substantially planar section 230 and an angled section 240. For example, the kick plate 200 may comprise a generally rectangular piece of sheet metal (e.g., aluminum, stainless steel, or the like) that has been formed along one edge to provide an angled section 240. For example, the planar section 230 may define a plane that is generally parallel to the front outlet plane defined by the planar portion 122 and/or the matrix surface 114. In an example embodiment, the front surface 201 of the planar section 230, the front surface 121 of the planar portion 120, and the front surface of the matrix surface 114 are generally coplanar.

The angled section 240 may angle out from the plane defined by the planar section 230 in the direction of the second axis 155. For example, the angled section 240 may be angled toward the second axis at same or a similar angle as the angled portion 123.

The kick plate 200 may comprise a vent opening 210 configured to allow the vent cover 110 and top portion 120 of the vent outlet 100 to pass therethrough. In example embodiments, a portion of the vent opening 210 is disposed within the planar section 230 and a portion of the vent opening 210 is disposed within the angled portion 240. For example, the vent opening 210 may be sized and shaped such that the kick plate 200 may be positioned such that the top edge 124 of the angled portion 123 is flush and/or adjacent with a top edge 211 of the vent opening 210, the flange 132 is flush or adjacent with and/or abuts the bottom edge 212 of the vent opening 210. In example embodiments, the vent opening 210 is generally aligned with the vent conduit 40 when the kick plate 200 is secured to the dishwasher 10. In other embodiments, the vent opening 210 is not aligned with the vent conduit 40 and the conduit portion 140 may comprise one or more angled sections such that the conduit portion 40 may be secured to the vent conduit 40 and the vent cover 110 may be generally aligned with the vent opening 210. For example, when the kick plate 200 is positioned in a first position, the top edge 124 of the angled portion 123 is flush and/or adjacent with a top edge 211 of the vent opening 210, the flange 132 is flush or adjacent with and/or abuts the bottom edge 212 of the vent opening 210.

Figure 13:
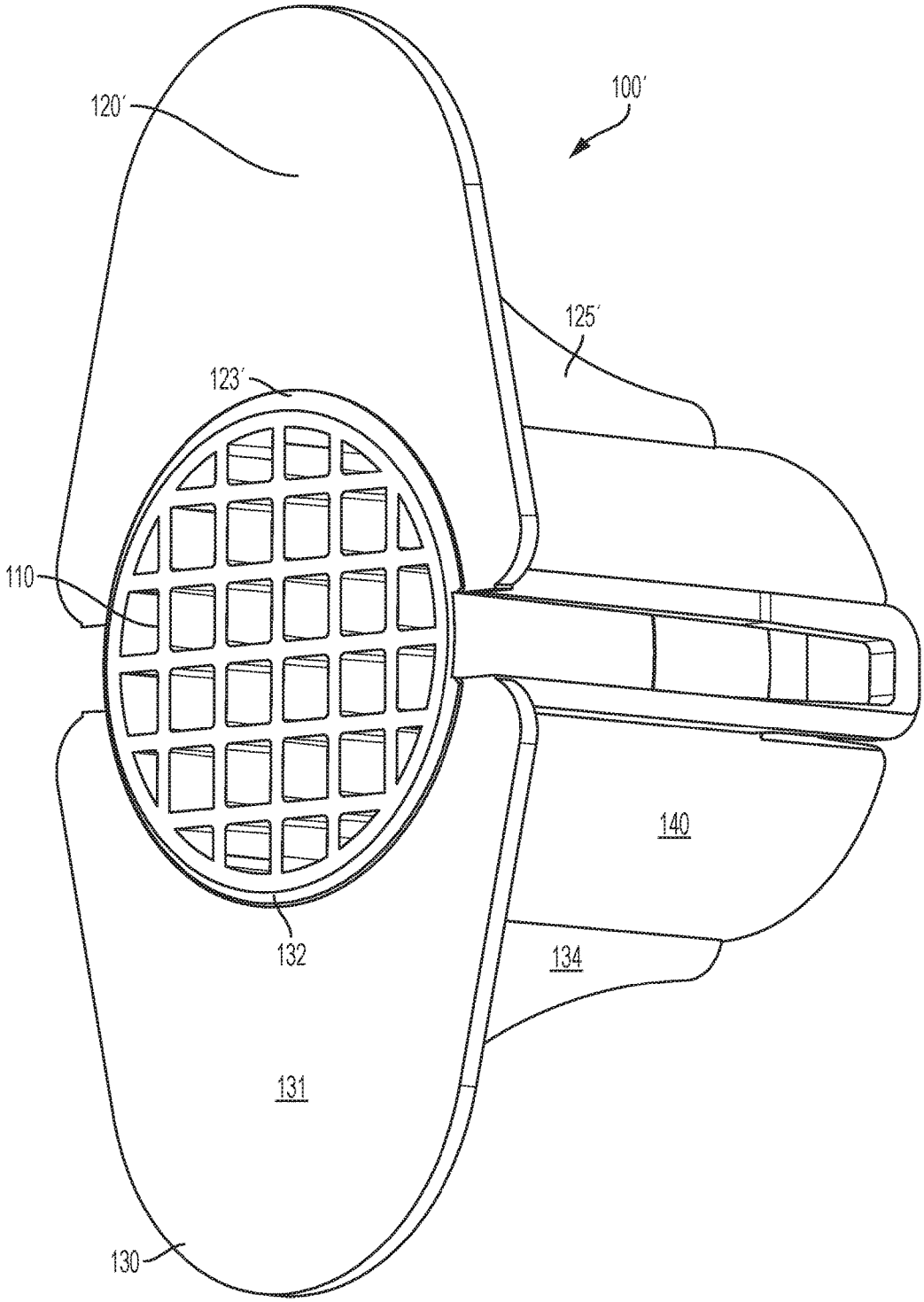
FIG. 13 is a perspective view of an alternative embodiment of a vent outlet, in accordance with an example embodiment.

In an example alternative embodiment, the kick plate 200 comprises a planar section 230 and does not comprise an angled portion 240. In this example embodiment, as shown in FIG. 13, the top portion 120' of the vent outlet 100' may be similar to the bottom portion 130. For example, the top portion 120' may comprise a planar portion but not comprise an angled portion. For example, a front surface of the top portion 120' may be recessed with respect to the front surface of the vent cover 110. For example, a flange 123' may be disposed between the vent cover 110 and the top portion 120', such that the top portion 120' may be positioned behind the kick plate. For example, the top portion 120' may be configured such that the front surface of the top portion 120' abuts and/or is adjacent to the back surface of the kick plate. For example, the flange 123' may recess the front surface of the top portion 120' approximately 0.5-3 mm with respect to the front surface of the vent cover 110. The top portion 120' may further comprise an upper support vein 125' similar to lower support vein 134. For example, the upper support vein 125' extends from a back surface of the top portion 120' to the conduit portion 140. In example embodiments, the upper support vein 125' is configured to provide structural support to the top portion 120' such that the top portion 120' may not be easily bent or twisted. For example, a user may not bend or twist the top portion 120' by pressing upon the front surface of the top portion 120' with their fingertips.

Positioning of the Kick Plate

In example embodiments, the kick plate 200 may be adjustable. For example, the adjustment slots 220 may allow the kick plate 200 to be adjusted in a direction that is generally parallel to the first axis 150. For example, the kick plate 200 may be vertically adjustable, in an example embodiment. When the vent outlet 100, 100' is installed into the dishwasher 10 (e.g., when the attachment mechanism mates 142 are secured to corresponding ones of the attachment mechanisms 42), the vent outlet 100, 100' may be configured to seal the vent opening 210 from intrusion of digits and/or other objects regardless of the position in which the kick plate 200 is secured. Additionally, the front surface of the vent cover 110 may be generally flush with the front surface of the kick plate 200.

Figure 3A:
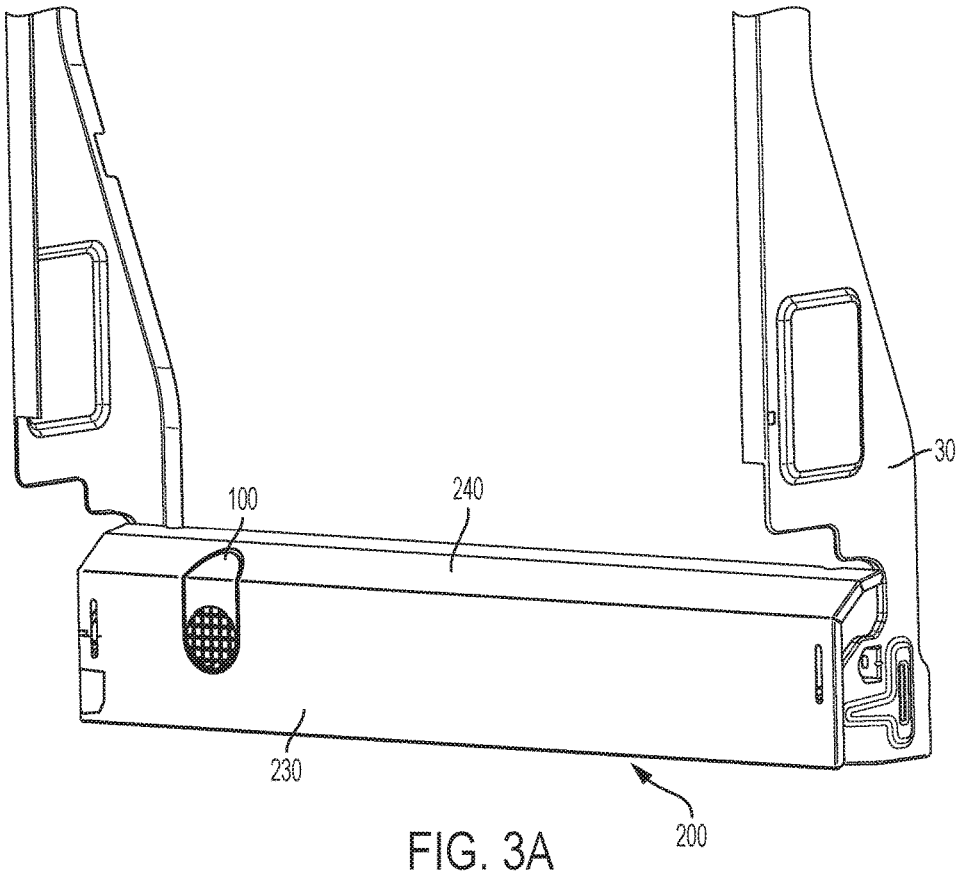
FIG. 3A is a partial front view of a dishwasher with the kick plate in a first position, in accordance with an example embodiment.
Figure 3B:
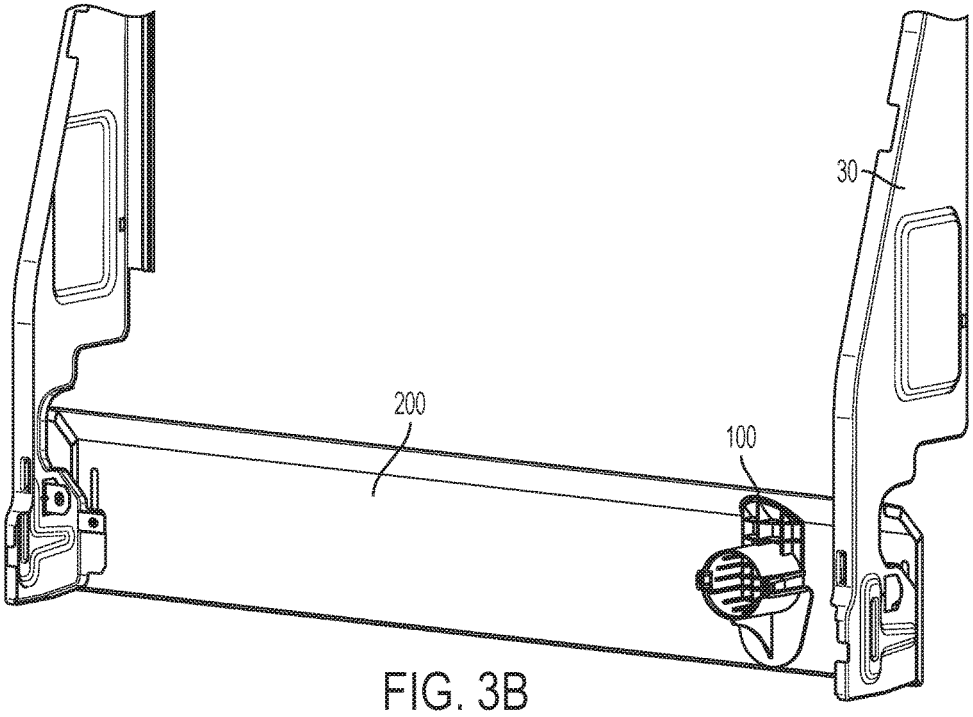
FIG. 3B is a partial back view of the dishwasher of FIG. 3A with the kick plate in the first position.
Figure 4:
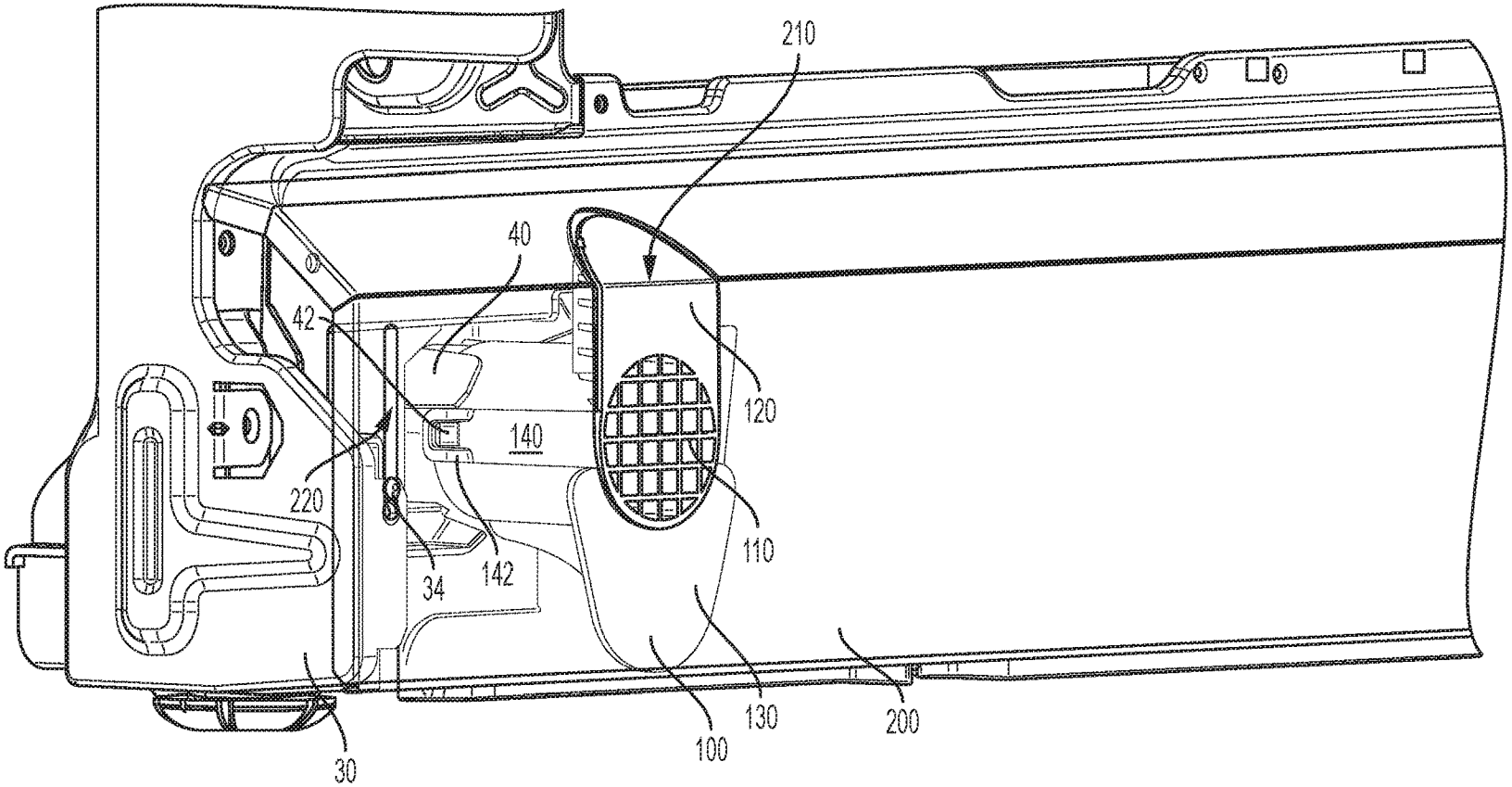
FIG. 4 is a close up view of a vent outlet and kick plate of the dishwasher with the kick plate in the first position, in accordance with an example embodiment.

For example, FIGS. 3A, 3B, and 4 illustrate example embodiments in which a kick plate 200 is secured to a dishwasher 10 having a vent outlet 100 installed therein with the kick plate 200 secured in a first position. In the first position, the kick plate 200 is at one end of the range in which the kick plate 200 may be adjusted. For example, fasteners maybe engage the bottom edge of the adjustment slots 220 to secure the kick plate 200 to the chassis 30. In the first position, the top edge 124 of the angled portion 123 is flush and/or adjacent with a top edge 211 of the vent outlet 210. Moreover, in the first position, the flange 132 may be adjacent and/or flush with and/or abut the bottom edge 212 of the vent opening 210. The bottom portion 130 may be positioned behind the kick plate 200 such that the bottom portion is generally not viewable by a user of the dishwasher 10. Thus, when the kick plate 200 is secured in the first position, the top portion 120 prevent intrusion of digits or other objects into the vent opening 210 around the vent cover 110 and the vent cover 110 prevents intrusion of digits or other objects into the flow path 145 while allowing fluids to enter and exit the flow path 145 through the openings 112.

Figure 5A:
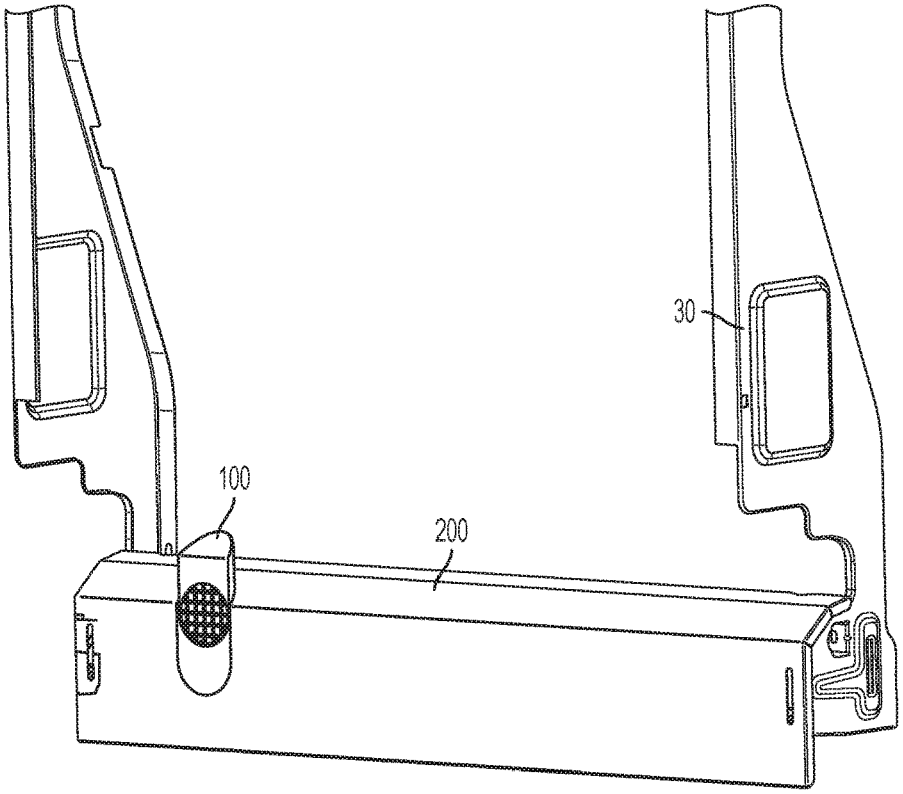
FIG. 5A is a partial front view of a dishwasher with the kick plate in a second position, in accordance with an example embodiment.
Figure 5B:
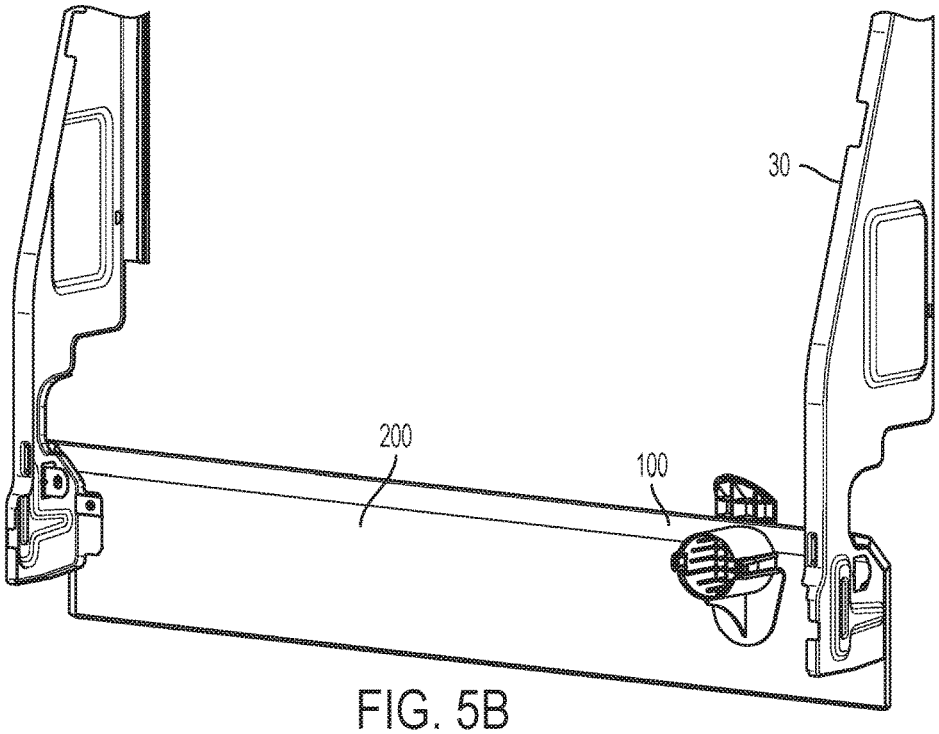
FIG. 5B is a partial back view of the dishwasher of FIG. 5A with the kick plate in the second position.
Figure 6:
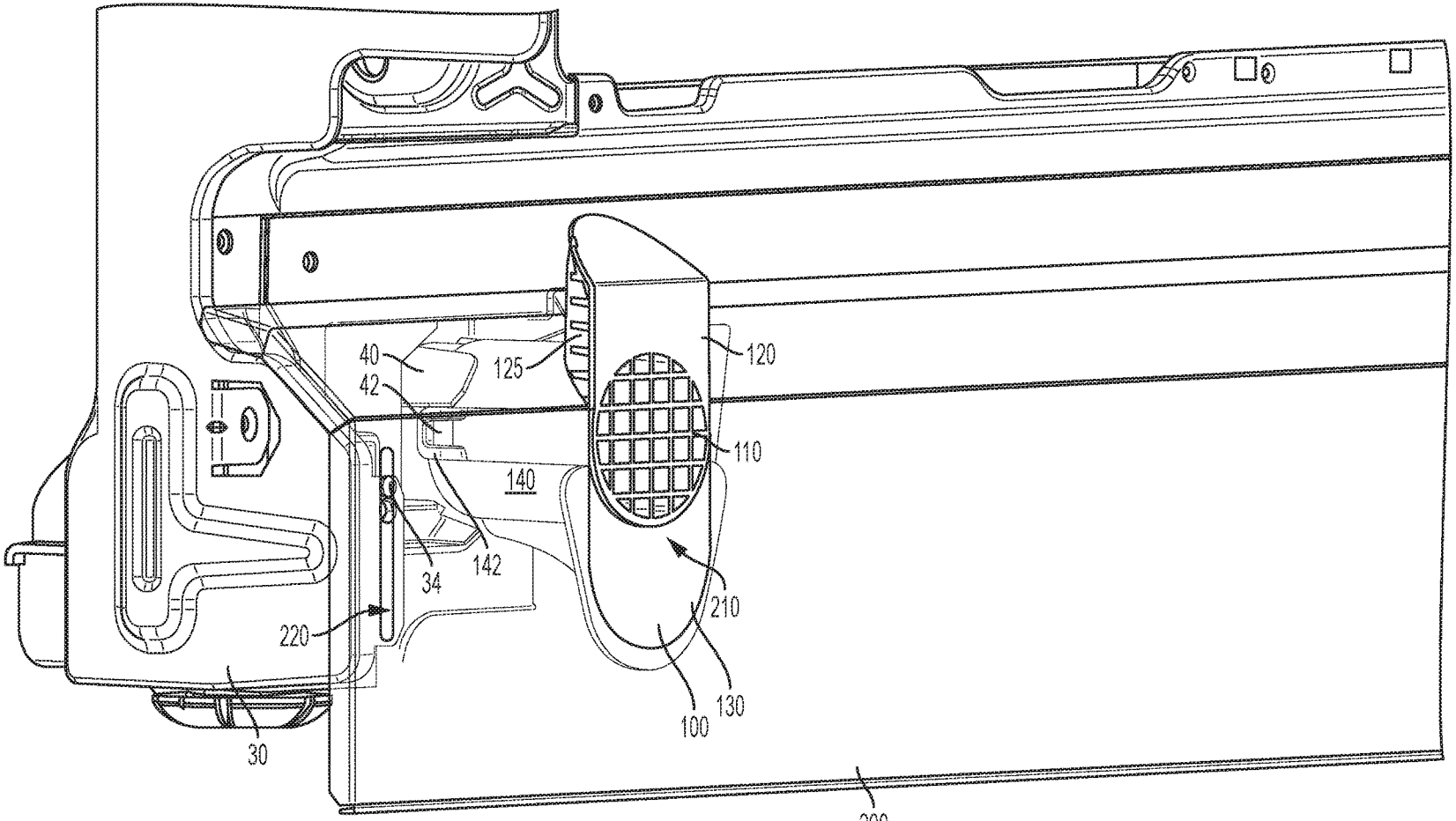
FIG. 6 is a close up view of a vent outlet and kick plate of a dishwasher with the kick plate in the second position, in accordance with an example embodiment.
Figure 7:
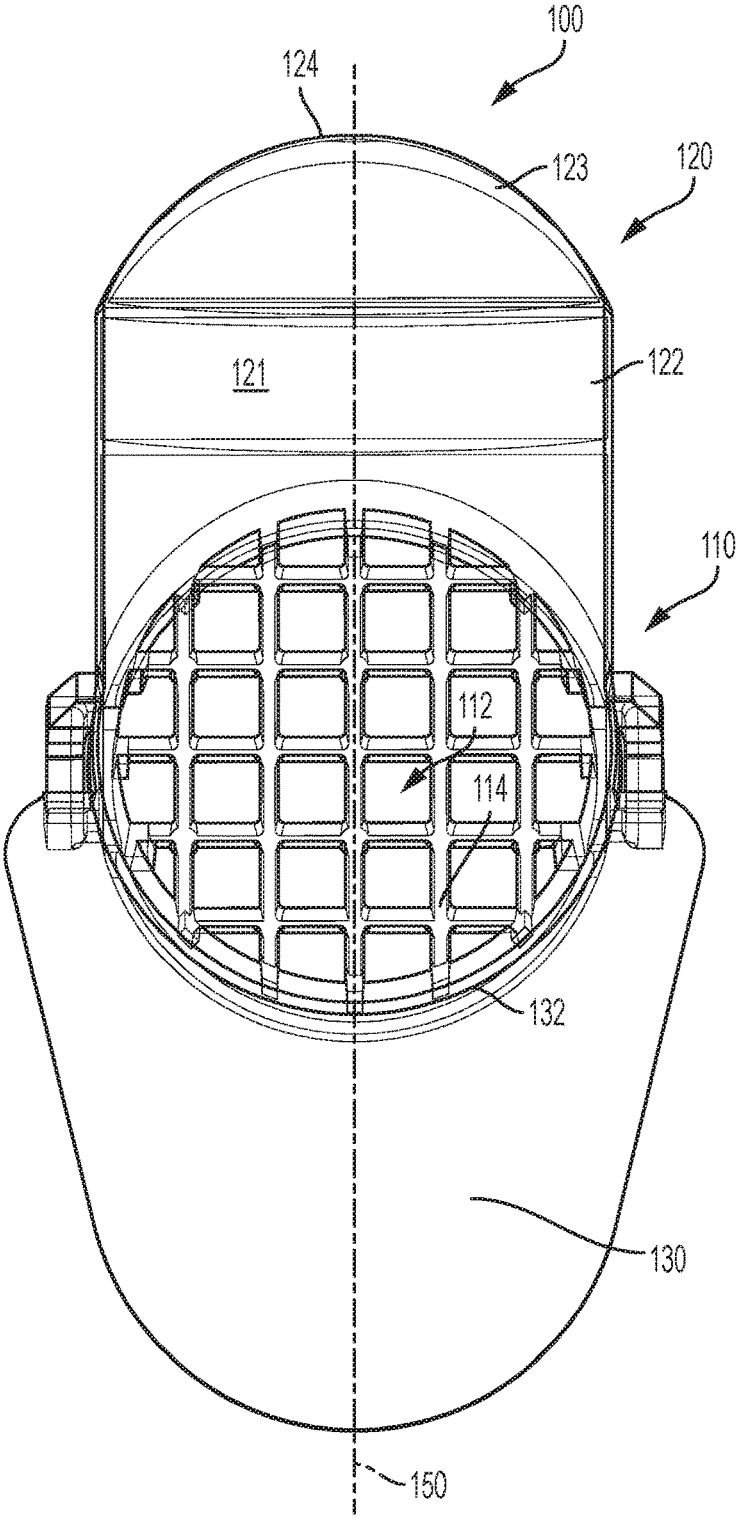
FIG. 7 is a front view of a vent outlet, in accordance with an example embodiment.
Figure 8:
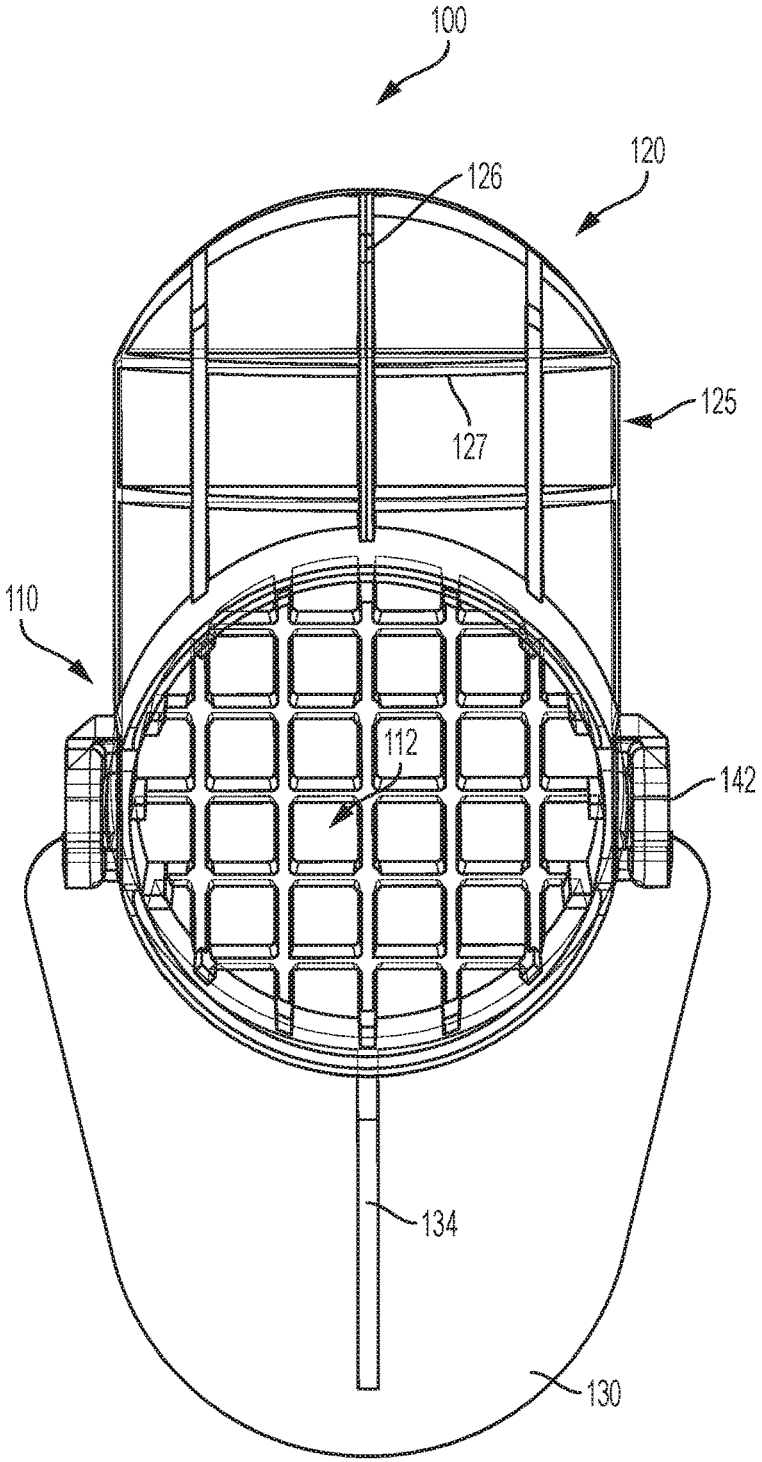
FIG. 8 is a back view of a vent outlet, in accordance with an example embodiment.
Figure 9:
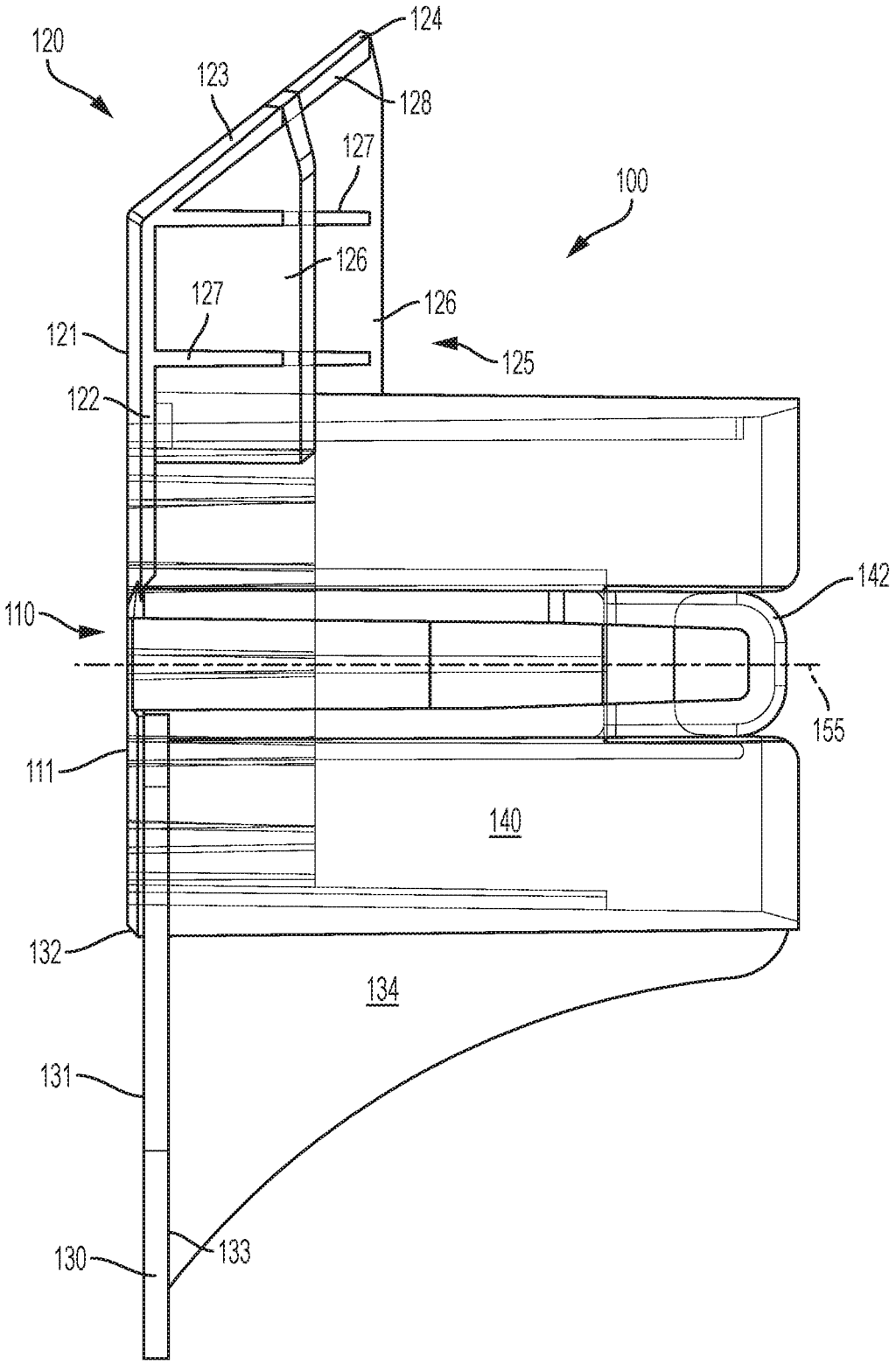
FIG. 9 is a side view of a vent outlet, in accordance with an example embodiment.
Figure 10:
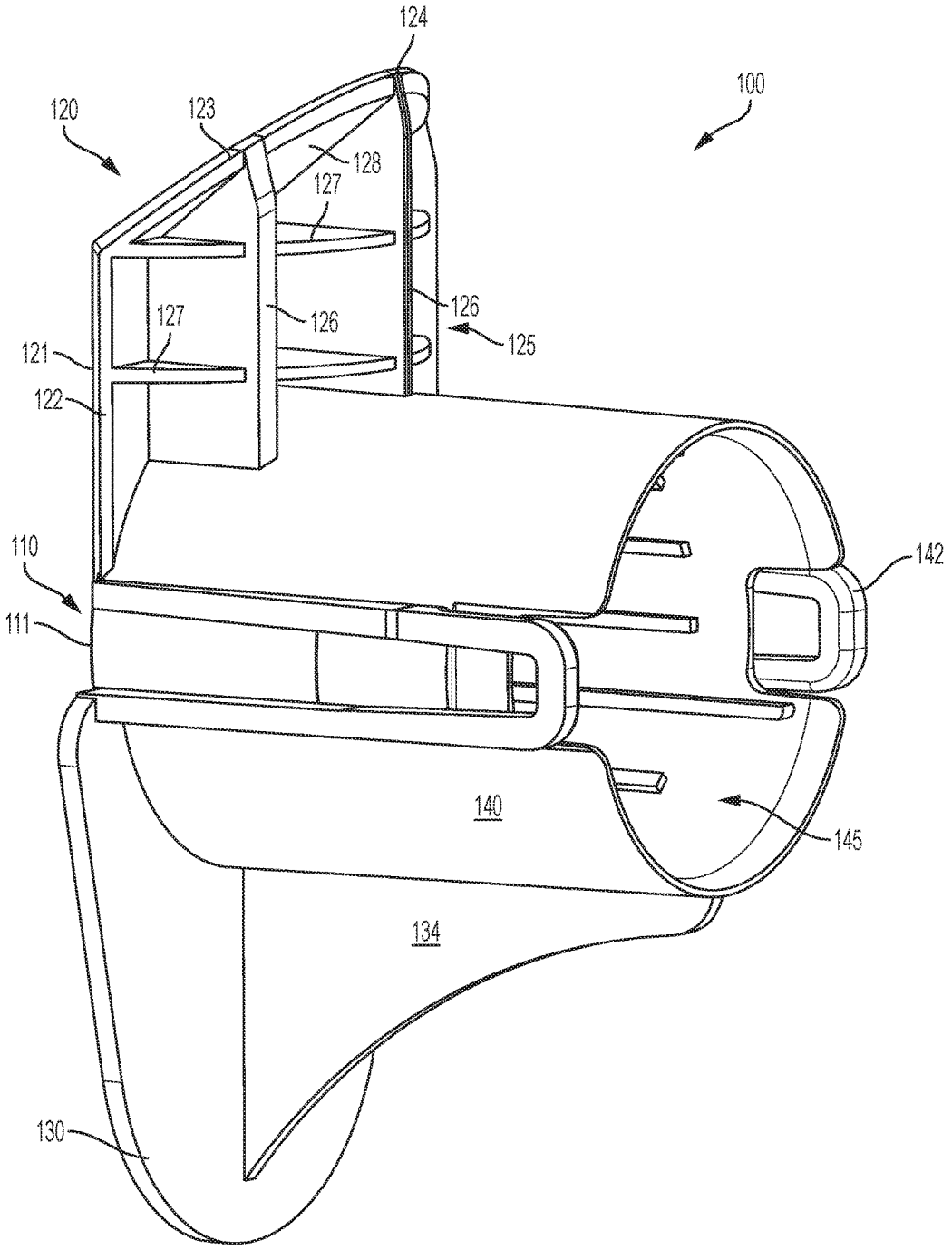
FIG. 10 is a perspective view of a vent outlet, in accordance with an example embodiment.
Figure 11:
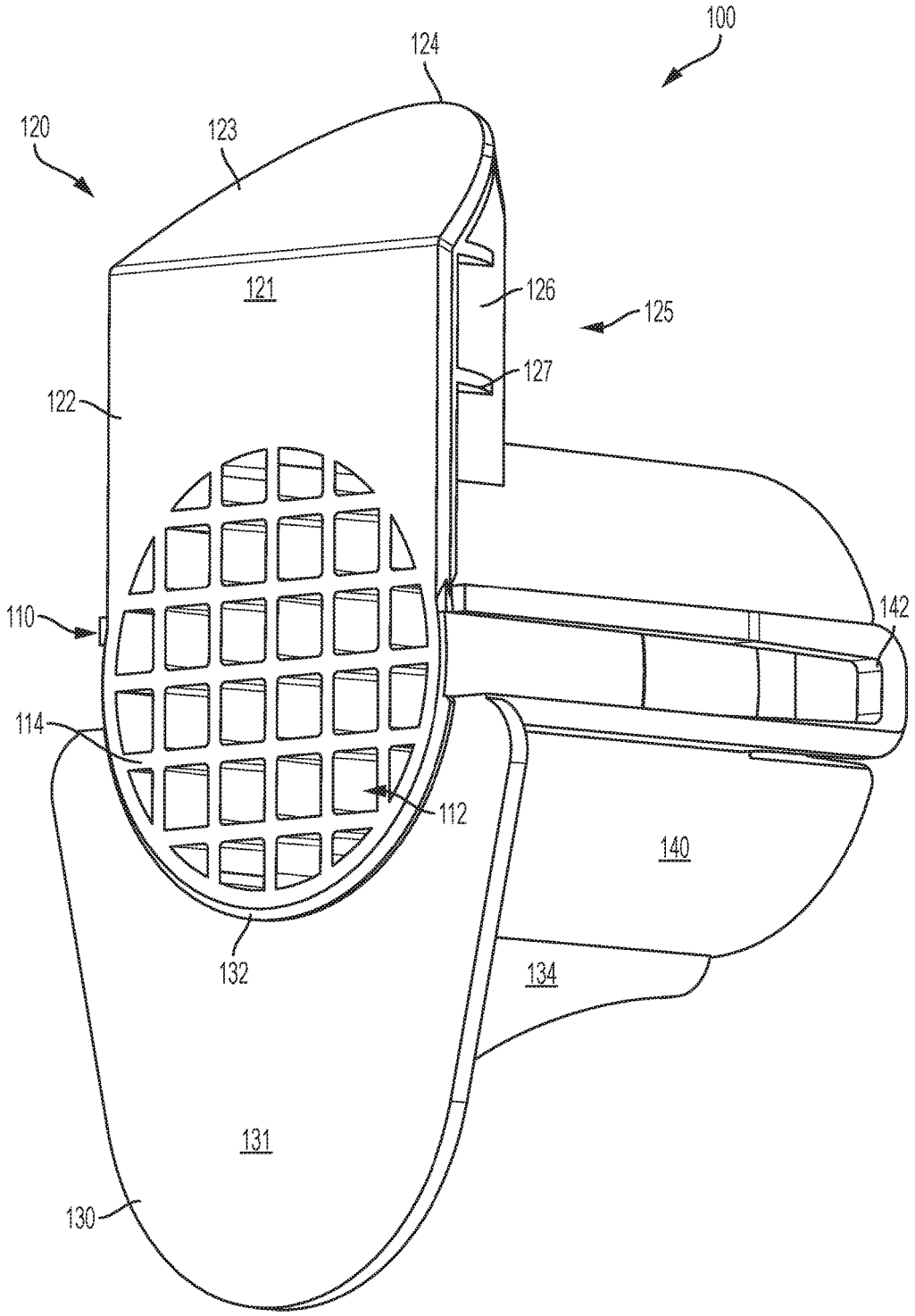
FIG. 11 is another perspective view of a vent outlet, in accordance with an example embodiment.

FIGS. 5A, 5B, and 6 illustrate example embodiments in which a kick plate 200 is secured to a dishwasher 10 having a vent outlet 100 installed therein with the kick plate 200 secured in a second position. In the second position, the kick plate 200 is at an opposite end of the range in which the kick plate 200 may be adjusted. For example, fasteners maybe engage the top edge of the adjustment slots 220 to secure the kick plate 200 to the chassis 30. In the second position, the top portion 120 may be disposed above the angled section 240 of the kick plate 200. For example, the top portion 120 may extend upward out through the vent opening 210. The bottom portion 130 may be viewable through the vent opening 210. For example, the bottom portion 130 may prevent intrusion of digits or other objects through a portion of the vent opening 210 disposed below the vent cover 110, when the kick plate 200 is in the second position. As noted above, the front surface of the bottom portion 130 is disposed behind and/or adjacent to the back surface of the kick plate 200. Additionally, the top portion 120 and the support vein matrix 125 may prevent intrusion of digits or other objects into the portion of the vent opening 210 disposed in the angled section 240 when the kick plate is positioned in the second position. Moreover, when the kick plate 200 is positioned in the second position, the vent cover 110 prevents intrusion of digits or other objects into the flow path 145 while allowing fluids to enter and exit the flow path 145 through the openings 112.

The first position and second position represent the extreme positions in which the kick plate 200 may be secured. For example, the first position may be the top of the adjustable range of the kick plate 200 and the second position may be the bottom of the adjustable range of the kick plate 200. In example embodiments, a plurality of positions of the kick plate 200 may exist between the first position and the second position. Thus, as the kick plate 200 is adjusted through the adjustment range from the first position to the second position, an increasing amount of the bottom portion 130 becomes viewable through the vent opening 210 and an increasing amount of the top portion 120 extends above the front surface and/or angled section 240 of the kick plate 200. However, in any position in which the kick plate 200 is positioned, the vent outlet 100 prevent intrusion of digits or other objects into the base portion 22 of the dishwasher 10 through the vent outlet 210. In example embodiments, the support vein matrix 125 may be configured to provide driving ribs for the adjustment of the kick plate 200 with respect to the vent outlet 100.

CONCLUSION

Example embodiments of the present invention provide a vent outlet 100 and adjustable kick plate 200 that allow the outlet end of an appliance vent to be co-located with a kick plate 200 that is configured to provide selective access to the bottom portion of an appliance. Moreover, the vent outlet 100 is configured to prevent intrusion of digits or other objects in the base portion of the appliance through a vent opening 210 in the kick plate 200 regardless of the position in which the adjustable kick plate 200 is secured. Some example embodiments comprise an appliance having a vent outlet 100 installed therein and an adjustable kick plate 200 secured thereto Therefore, embodiments of the present invention provide the advantage of allowing the outlet end of a vent to be positioned in the base portion of an appliance without hampering the adjustability of the kick plate and still providing (a) protection against intrusion of digits or other objects into the base portion of the dishwasher (b) dampening noise emitted from the base portion of the dishwasher regardless of the position in which the kick plate is positioned and (c) allowing the kick plate to be selectively detachable from the appliance (e.g., for installing the appliance) without affecting the vent conduit and/or vent outlet.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A vent outlet for an appliance having an adjustable kick plate configured to enclose a base portion of the appliance, the vent outlet comprising:

a top portion comprising a planar portion;

a vent cover;

a bottom portion that is recessed with respect to the front surface of the vent cover, wherein the planar portion, the vent cover, and the bottom portion are generally positioned along a first axis such that the planar portion is disposed on a first side of the vent cover and the bottom portion is disposed on a second side of the vent cover, the second side being opposite the first side along the first axis; and a conduit portion extending backward from a plane defined by the front surface of the vent cover and the planar portion and configured to secure the vent outlet to a vent conduit of the appliance.

2. The vent outlet of claim 1 wherein the top portion further comprises:

an angled portion; and a support vein matrix partially filling a space between the angled portion and the conduit portion.

3. The vent outlet of claim 2, wherein a top edge of the angled portion is curved.

4. The vent outlet of claim 1, wherein the front surface of the vent cover comprises a matrix surface comprising a plurality of openings sized to prevent intrusion of digits while allowing fluid to pass through the front surface of the vent cover.

5. The vent outlet of claim 4, wherein each of the plurality of openings is approximately 3-6 mm in size.

6. The vent outlet of claim 1, wherein a lower support vein extends between the bottom portion and the conduit portion, the lower support vein configured to prevent bending or twisting of the bottom portion.

7. The vent outlet of claim 1, wherein a front surface of the bottom portion is recessed by approximately 0.5-3 mm with respect to the front surface of the vent cover.

8. The vent outlet of claim 1, wherein the conduit portion comprises at least one attachment mechanism mate on an end thereof opposite the vent cover and configured to secure the vent outlet to a vent conduit of the appliance.

9. The vent outlet of claim 1, wherein the conduit portion defines a second axis that is normal to the first axis.

10. An appliance comprising:

an adjustable kick plate comprising a vent opening;

a vent conduit disposed behind the kick plate;

a vent outlet secured to the vent conduit and configured to prevent access to a base portion of the appliance through the vent opening, the vent outlet comprising:

a top portion configured to prevent access to the base portion of the appliance through a portion of the vent opening located below a vent cover when the kick plate is in a position other than a second position;

the vent cover configured to prevent intrusion of digits into a flow path defined by the vent outlet and allow fluid to pass through the vent cover; and a bottom portion positioned behind the kick plate and configured to prevent access to the base portion of the appliance through a portion of the vent opening located below the vent cover when the kick plate is in a position other than a first position.

11. The appliance of claim 10, wherein a front surface of the top portion and a front surface of the vent cover are generally coplanar and flush with a front surface of the kick plate.

12. The appliance of claim 10, wherein the top portion comprises a top edge that is configured to align with the top edge of the vent opening when the kick plate is in the first position.

13. The appliance of claim 10, wherein the top portion is positioned behind the kick plate and a front surface of the vent cover is generally coplanar and flush with a front surface of the kick plate.

14. The appliance of claim 10, wherein the first position is located at one end of an adjustment range of the adjustable kick plate and the second position is located at an opposite end of the adjustment range of the adjustable kick plate.

15. The appliance of claim 10, wherein the bottom portion is recessed with respect to the vent cover by approximately a thickness of the kick plate.

16. The appliance of claim 10, wherein the top portion of the vent outlet comprises a support vein matrix disposed behind the front surface of the top portion and configured to prevent intrusion of digits into the base portion of the appliance through a portion of the vent opening located above the vent cover when the kick plate is in a position other than the first position.

17. The appliance of claim 10, wherein the kick plate comprises a planar section and an angled section, the angled section angling back toward the base portion of the appliance.

18. The appliance of claim 10, wherein the vent outlet further comprises a conduit portion configured to provide a flow path for fluids between the vent conduit and the vent cover.

19. The appliance of claim 18, wherein the vent conduit comprises one or more attachment mechanisms and the conduit portion comprises one or more corresponding attachment mechanisms, at least one of the one or more attachment mechanisms mated to a corresponding one of the one or more attachment mechanism mates to secure the vent outlet to the vent conduit.

20. The appliance of claim 10, wherein a front surface of the vent cover comprises a matrix surface comprising a plurality of openings, the openings configured to (a) prevent intrusion of digits into the flow path and (b) allow fluid to pass through the front surface of the vent cover.

* * * * *